US006054812A

United States Patent [19]

Lesch

[11] Patent Number: 6,054,812

[45] Date of Patent: Apr. 25, 2000

[54] MULTIFILAMENT LIGHT BULB

[76] Inventor: Mark Joseph Lesch, 99 Toronto Road, St. Helena Welkom, South Africa

[21] Appl. No.: 09/043,198

[22] PCT Filed: Sep. 13, 1996

[86] PCT No.: PCT/IB96/00946

§ 371 Date: Jul. 13, 1998

§ 102(e) Date: Jul. 13, 1998

[87] PCT Pub. No.: WO97/10611

PCT Pub. Date: Mar. 20, 1997

[30] Foreign Application Priority Data

| | | | |
|---|---|---|---|
| Sep. 15, 1995 | [ZA] | South Africa | 95/7762 |
| Sep. 29, 1995 | [ZA] | South Africa | 95/8178 |
| Feb. 9, 1996 | [ZA] | South Africa | 95/1034 |

[51] Int. Cl.[7] ..... H01J 7/44

[52] U.S. Cl. ..... 315/68; 315/64; 315/65

[58] Field of Search ..... 315/64, 65, 66, 315/67, 68; 313/113, 222, 273

[56] References Cited

U.S. PATENT DOCUMENTS

| | | | |
|---|---|---|---|
| 708,159 | 9/1902 | Meyers | 315/68 |
| 955,748 | 4/1910 | Bill et al. | 315/68 |
| 982,470 | 1/1911 | Camp, Jr. | 315/68 |
| 1,513,407 | 10/1924 | Lombos | 315/68 |
| 1,742,630 | 1/1930 | Becket | 315/68 |
| 2,139,762 | 12/1938 | Major | 315/68 |
| 2,150,232 | 3/1939 | Major | 315/68 |
| 5,345,143 | 9/1994 | Little | 315/64 |

FOREIGN PATENT DOCUMENTS

| | | | |
|---|---|---|---|
| 467271 | 6/1937 | United Kingdom | 315/64 |

*Primary Examiner*—Don Wong
*Assistant Examiner*—Wilson Lee
*Attorney, Agent, or Firm*—Nixon Peabody LLP

[57] ABSTRACT

There is provided an electric current utilising facility conventionally connectable to an electric current supply outlet for causing the diversion of current along a desired circuit in response to manipulation of the facility. One embodiment of an electric current utilising facility is in the form of a re-usable light bulb (10). The bulb (10) comprises a circuit carrying device in the form of a globe (12) fitted with a number of independent filament circuits (14), and a circuit selecting mechanism providing a swivellable member firmly securable to a matchingly formed current supply outlet as provided by a sleeve (16) which snugly but freely swivellably in the direction of arrow (17) sits onto the stem (18) of the globe (12) while being retained against slipping owing to the stem (18) providing a ridge (20) on its socket engaging side. The sleeve (16) is fitted with pins (22) enabling the bayonet coupling engagement of the bulb (10) to a conventional light bulb socket outlet.

24 Claims, 1 Drawing Sheet

MULTIFILAMENT LIGHT BULB

(2) CROSS REFERENCED APPLICATIONS

Figure 1:
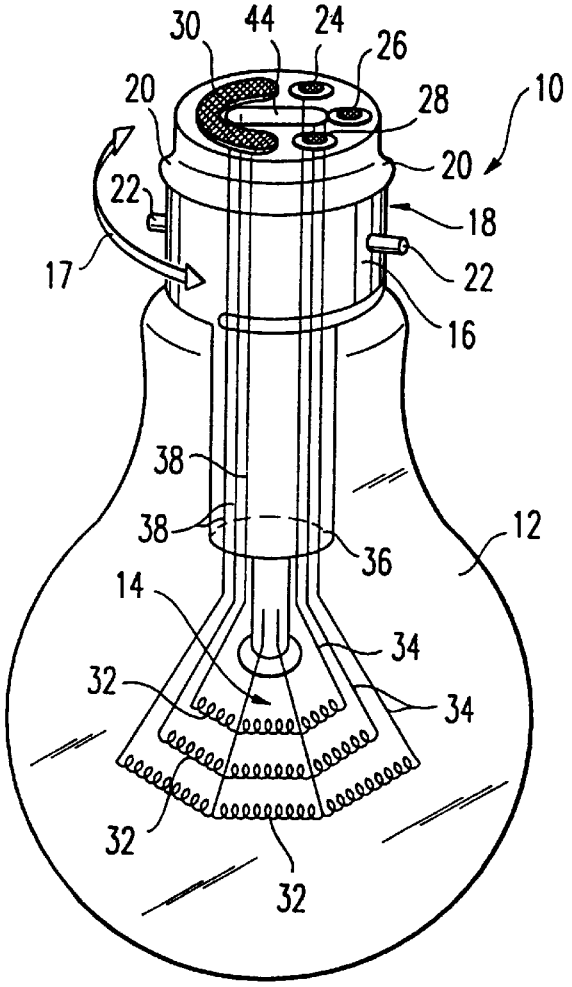

The following prior art disclosures relate to the same field of invention.

CN 1 052 749 A
CN 1 057 129 A
CN 1 062 618 A
DE 2 924 200 C
ES 8 600 568 A
GB 1 362 646 A
JP 60 189 157 A
RU 2 000 629 C
RU 2 007 781 I
U.S. Pat. No. 3,673,534
RU 2 031 475 C1
U.S. Pat. No. 4,179,637 A

(3) BACKGROUND TO THE INVENTION

A filament type light bulb only has a certain lifespan. Once the filament has become worn away in response to continuous use, it breaks thus rendering the bulb defective and of no use any more. At this time the bulb, except for the filament, is normally still intact but has to be disposed of The object of this invention is thus to provide a light bulb which can be re-used thus lengthening its useful lifespan.

(3.1) FIELD OF THE INVENTION

This invention relates to an electric current utilising facility connectable to an electric current supply outlet for causing the conduction of current along a desired circuit along the facility in response to manipulation of the facility. Although not so limited, he invention finds useful application when applied to a multiple use filament type light bulb.

(3.2) PRIOR ART DESCRIPTION

Multi-filament light bulbs are known in the art. Various approaches of changing between the filaments have been suggested. According to one arrangement, another filament is caused to become electrically connected by the base of the lamp being formed with a plurality of suitably isolated foldable contact members with a further contact member becoming exposed on folding away the contact member of the defective filament. (U.S. Pat. No. 3,673,534).

(4) SUMMARY OF THE INVENTION

According to the invention there is provided an electric current utilising facility conventionally connectable to an electric current supply outlet for causing the diversion of current along a desired circuit in response to manipulation of the facility.

(5) BRIEF DESCRIPTION OF THE DRAWING

The invention is now described, by way of example, with reference to the accompanying drawings. In the drawings FIG. 1 three dimensionally shows one embodiment of an electric current utilising facility in the form of a light bulb, FIG. 2 shows another embodiment of the light bulb of the invention in side elevation, and FIG. 3 three dimensionally shows an adapter, according to the invention by means of which a bayonet type light bulb is connectable to a screw in socket type outlet.

(6) DETAILED DESCRIPTION OF THE DRAWINGS

Figure 2:
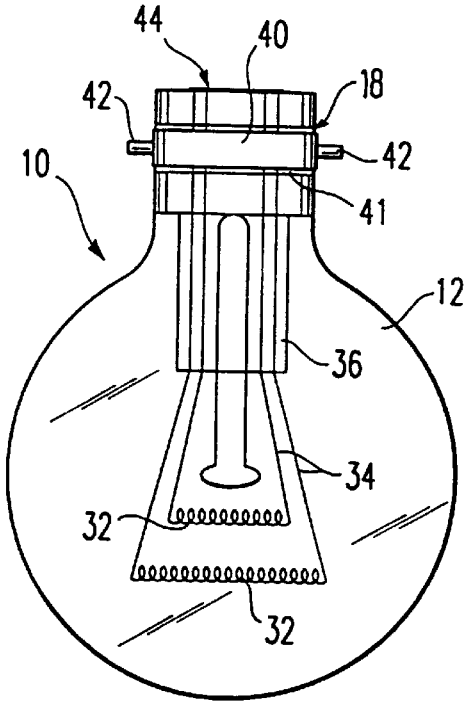

Referring to FIG. 1 of the drawings, one embodiment of an electric current utilising facility in the form of a re-usable light bulb is generally indicated by reference numeral 10. The bulb 10 comprises a circuit carrying device in the form of a globe 12 fitted with a number of independent filament circuits 14, and a circuit selecting mechanism providing a swivellable member firmly securable to a matchingly formed current supply outlet as provided by a sleeve 16 which snugly but freely swivellably in the direction of arrow 17 sits onto the stem 18 of the globe 12 while being retained against slipping owing to the stem 18 providing a ridge 20 on its socket engaging side. The sleeve 16 is fitted with pins 22 enabling the bayonet coupling engagement of the bulb 10 to a conventional light bulb socket outlet.

Each circuit 14 extends between its own contact 24, 26 and 28 and an arcuate common base contact 30 and incorporates a filament 32. The leads 34 of the circuits 14 and filaments 32 are conventionally light bulb fashion supported to also limit the possibility of short circuiting between the circuits 14. In this respect the three independent lead wires of the three filaments 32 can, for example, extend on both sides along capillary apertures along a core 36. The globe 12 is fitted with fuses 38 along each of the circuits 14.

Referring to FIG. 2 and in another embodiment of the light bulb 10, the member firmly securable to a matchingly formed current supply outlet is in this embodiment in the form of a ring 40 which snugly but freely swivellably fits along a groove 41 in the stem 18 of the globe 12. The ring 40 is fitted with pins 42 spaced to bayonet coupling fashion engage the bulb 10 to a conventional light bulb socket outlet. Like components of this embodiment are given the same reference numbers as in the FIG. 1 embodiment. Although the ring 40 is shown freely swivellable, its extent of swivelling can be limited with the contacts being suitably positioned to cause connection of a circuit when swivelled to and end stop. To this effect the ring can thus be coveredly sunken with the pins projecting through slots of suitable lengths to achieve the end stop effect.

The contact mounting base 44 in the case of both embodiments can be in the form of a printed circuit, or can be glass based or be from injection moulded substance fitted with contacts.

Figure 3:
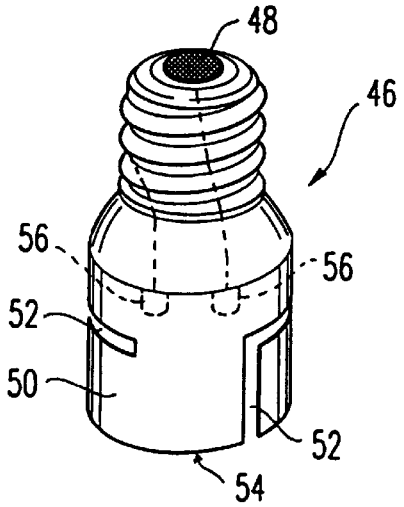

Referring to FIG. 3 an adapter 46 enables the connection of a bayonet connection type light bulb 10 to a conventional screw in type electric current supply outlet. The adapter 46 thus has an end electrical contact 48 isolated from its side wall 50. To permit bayonet type engagement of the bulb 10 with the adapter 46, its side wall is slotted with generally L-shaped slots 52 extending inward from the edge 54 of the adapter 46 into which the pins 22 or 42 are received and held once the adapter 10 is fitted to a bulb 10. The end of the adapter 46 engageable with the screw in type socket outlet is suitably threaded. Although not shown in detail, a pair of contact 56 are mounted within the adapter 24 in the configuration of the contacts of a bayonet connection type outlet. The one contact is this electrically connected to the side wall 50 and the other to the electrical contact 48 while being isolated from one another by, for example, being mounted in a plug of isolating material (not shown in detail).

Although the adapter 46 is shown separately it will be appreciated that it can also be in the form of a permanent fixture to the bulb 10. In such case connection between the adapter 46 and the bulb 10 need not be by way of the slots 52 although the adapter 46 will naturally have to accommodate the pins 22, 42 of the bulb 10.

In use and referring first to FIGS. 1 and 2, the bulb 10 is operatively mounted in a way similar to an ordinary bayonet coupling type bulb with the pins 22, 42 coming into engagement with the slots of the bayonet type outlet. The one contact of the outlet will thus make electrical connection with the common base contact 30 while the other contact will make electrical contact with the one of the contacts 24, 26 or 28. If not making proper contact or if making contact with two of the contacts 24, 26 or 28, the globe 12 is simply swivelled by hand until the appropriate contact configuration is achieved. As the two contacts of the conventional bayonet couplable type outlet are spring loaded, proper contact is maintained. It will be appreciated that the contacts 24, 26, 28 and 30 of the base must not stand up to a large extent from their base to permit ease of swivelling the globe 12 relative to the outlet once operatively mounted.

The selected filament 32 thus serves as light providing source once the bulb 10 is activated. When one filament 32 becomes defect, normally because of its burning away and breaking off, the bulb 10 can still be used by simply manually swivelling the globe 12 relative to its outlet until another base contact makes the required electric connection thus interspacing a further filament 32 along the circuit. The FIG. 1 embodiment provides for even a third filament 32 and even more can be fitted depending on the available space.

Although discussed as a long life-type bulb as compared to a single filament type, it will be appreciated that the bulb can serve other purposes as well. The filaments 32 can, for example, have differing values thus enabling setting the brightness of the light by simply appropriately swivelling the globe 12 relative to the outlet to which it is connected. It can even serve as an on off switch by simple swivelling the bulb out of appropriate contact When requiring connection of a bayonet connection type light bulb 10 to a conventional screw in type electric current supply outlet, the adapter 46 is used. The adapter 46 is simply bayonet fashion connected to a bulb 10, in a way similar too discussed with respect to the bayonet type coupling, and the assembly then engaged with a screw fashion engageable outlet until the end contact 48 makes electrical contact. Although not shown the adapter contacts 56 can also be spring loaded to promote continuous electrical contact. The adapter 46 can also be in the form of a permanent fitting, as said above.

If not in the form of a permanent fitting, the bulb 10 and adapter 46 form a set assemblable into an assembly comprising the bulb 10 as fitted with the adapter 46.

What is claimed is:

1. An electric current utilizing facility comprising:

a circuit carrying device having a stem, fitted with a number of independent filament circuits, each of the circuits extending between its own contact and a common base contact the leads of the circuits being supported to limit the possibility of short circuiting between the circuits; and a circuit selecting mechanism comprising a sleeve, which is freely swivelable on the stem of the circuit carrying device, the sleeve being fitted with pins enabling the bayonet coupling engagement of the bulb to a conventional light bulb socket outlet, wherein the stem is provided with a ridge on its socket engaging side, to retain the sleeve against slipping from the stem.

2. An electric current utilizing facility according to claim 1, wherein the circuit carrying device is fitted with fuses along each of the circuits.

3. An electric current utilizing facility according to claim 1, wherein three independent lead wires of the filament circuits extend on both sides along capillary apertures along a core.

4. An electric current utilizing facility according to claim 1, wherein the light bulb further comprises:

a contact mounting base in the form of a printed circuit, fitted with contacts.

5. An electric current utilizing facility according to claim 1, wherein the light bulb further comprises:

a contact mounting base, being glass based and fitted with contacts.

6. An electric current utilizing facility according to claim 1, wherein the light bulb further comprises:

a contact mounting base, made from an injection molded substance fitted with contacts.

7. An electric current utilizing facility according to claim 1, wherein the filaments have differing values thus enabling setting the brightness of the light by swiveling the circuit carrying device.

8. An electric current utilizing facility according to claim 1, further comprising:

an adapter for enabling the connection of a bayonet connection type light bulb to a conventional screw-in type electric current supply outlet, the adapter having an end electrical contact isolated from its side wall while being suitably arranged to permit the bulb and the adapter to snugly fit onto the sleeve of the light bulb while the other side of the adapter is conventionally threaded for engaging the conventional screw-in type outlet, the adapter being fitted with a pair of contacts suitably mounted inside it to enable a conventional bayonet type connection between the bulb and the adapter with the contacts of the adapter being connected the one to the side wall, and the other to the adapter end contact for causing the bulb to be powered via such screw-in type current supply outlet.

9. An electric current utilizing facility according to claim 8, wherein the adapter is appropriately slotted from its bulb engaging edge to permit a conventional bayonet type coupling between the bulb and the adapter.

10. An electric current utilizing facility according to claim 8, wherein the adapter forms a permanent feature of the bulb.

11. A light bulb comprising:

a circuit carrying device having a plurality of circuits each providing a separate illuminating filament with a socket connecting end of the circuit carrying device being fitted with an appropriate pin presenting a swivelable member conventionally engaging a bayonet type circuit carrying device engaging socket with appropriate swiveling of the circuit carrying device relative to the swivelable member and a socket type current supply outlet, such that once the circuit carrying device is operatively fitted, the circuit carrying device is swiveled to engage an electrical connection of any one of the filaments; and an adapter for connecting the light bulb to a conventional screw-in type outlet, with one side of the adapter being conventionally threaded for engaging the screw-in type outlet wherein the adapter is formed to enable the connection of a bayonet type light bulb to a conventional screw-in type electric current supply outlet with the adapter being suitably slotted from its bulb engaging edge to permit connection between the bulb and the adapter which swivelably fits onto the bulb, the adapter as having an end electrical contact isolated from its side wall, being fitted with a pair of contacts suitably mounted inside it to enable, in conjunction with its slotting arrangement, a conventional bayonet type connection between the bulb and the adapter while one contact of the adapter is connected to the side wall and the other contact to the adapter end contact such that the lamp is powered via the screw-in type supply outlet.

12. A light bulb according to claim 11, wherein each circuit extends between its own contact and an arcuate common base contact.

13. A light bulb according to claim 11, wherein the leads of the circuits and filaments are supported to limit the possibility of short circuiting between the circuits; that the circuit carrying device is fitted with fuses along each of the circuits.

14. A light bulb according to claim 11, wherein the swivelable member is provided by a sleeve, which swivelably sits onto the stem of the circuit carrying device, while being retained against slipping owing to stem providing a ridge on its socket engaging side.

15. A light bulb according to claim 11, wherein the swivelable member is in the form of a ring which swivelably fits along a groove in the stem of the circuit carrying device.

16. A light bulb according to claim 15, wherein the extent of swiveling of ring is limited with the contacts being suitably positioned to cause connection of a circuit when swiveled to and end stop, wherein the ring is covertly sunken with the pins projecting through slots of suitable lengths.

17. A light bulb according to claim 11, wherein three independent lead wires of the filaments extend on both sides along capillary apertures along a core.

18. A light bulb according to claim 11, wherein the light bulb further comprises:

a contact mounting base in the form of a printed circuit, fitted with contacts.

19. A light bulb according to claim 11, wherein the light bulb further comprises:

a contact mounting base, being glass based and fitted with contacts.

20. A light bulb according to claim 11, wherein the light bulb further comprises:

a contact mounting base, made from an injection molded substance fitted with contacts.

21. A light bulb according to claim 11, wherein the filaments have differing values thus enabling the brightness of the light by simply appropriately swiveling the circuit carrying device.

22. A light bulb according to claim 11, wherein the side wall of the adapter is slotted with generally L-shaped slots extending inward from the edge of the adapter into which the pins are received and held.

23. A light bulb according to claim 11, wherein the contacts of the adapter are isolated from one another by being mounted in a plug of isolating material.

24. A light bulb according to claim 11, wherein the adapter contacts are spring loaded to promote continuous electrical contact.

* * * * *